US006169875B1

(12) United States Patent
Tidrick

(10) Patent No.: US 6,169,875 B1
(45) **Date of Patent: *Jan. 2, 2001**

(54) ENVELOPE TRANSPORT STRUCTURE

(75) Inventor: Robert C. Tidrick, Portland, OR (US)

(73) Assignee: Xerox Corporation, Stamford, CT (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/087,672

(22) Filed: May 29, 1998

(51) Int. Cl.[7] ..... G03G 15/20; G03G 21/00
(52) U.S. Cl. ..... 399/400
(58) Field of Search ..... 399/322, 400, 399/397; 271/2

(56) References Cited

U.S. PATENT DOCUMENTS

| | | | | |
|---|---|---|---|---|
| 4,493,548 | * | 1/1985 | Ateya | 399/400 |
| 4,525,057 | * | 6/1985 | Kaufmann et al. | 399/322 |
| 4,843,214 | * | 6/1989 | Higashi et al. | 399/328 X |
| 4,958,195 | | 9/1990 | Firth, III et al. | 355/290 |
| 5,130,752 | | 7/1992 | Morishita et al. | 355/274 |
| 5,166,737 | * | 11/1992 | Tomito | 399/400 |
| 5,268,726 | | 12/1993 | Oleksa et al. | 355/290 |
| 5,450,187 | | 9/1995 | Pei et al. | 355/311 |
| 5,618,375 | | 4/1997 | Suzuki et al. | 156/442.3 |
| 5,678,160 | | 10/1997 | Williams | 399/400 |
| 5,870,661 | * | 2/1999 | Menzel et al. | 399/400 |

FOREIGN PATENT DOCUMENTS 6-292152 * 11/1988 (JP) .

* cited by examiner

*Primary Examiner*—Fred L. Braun
(74) *Attorney, Agent, or Firm*—Jeannette M. Walder

(57) ABSTRACT

A media transport unit includes an envelope transport structure that utilizes support fingers directly under the envelope. The support fingers are canted toward the center line of the paper path. The envelope flap passes over the support fingers at an angle that prevents the envelope flap from catching a support finger and potentially causing envelope wrinkling or a jam. The support fingers on either side of the area over which the envelope passes are canted away from the center line of the paper path to prevent the edges of full width media from catching the surface of a support finger.

20 Claims, 3 Drawing Sheets

ENVELOPE TRANSPORT STRUCTURE

FIELD OF INVENTION

This invention relates generally to imaging of envelopes and, more specifically, to an envelope transport structure that minimizes wrinkling of envelopes during an imaging process.

BACKGROUND OF THE INVENTION

In electrostatic or electrophotographic image forming apparatus, such as monochrome and color laser printers and photocopiers, it is common to fuse a loose toner image by passing the imaged media through a fusing nip. The fusing nip is typically formed from a first fusing roller urged against a second fusing roller to create a pressurized nip through which the media passes. One or both of the fusing rollers are typically heated to increase the temperature within the nip.

In those imaging systems utilizing a fusing nip as described above, wrinkling of envelopes within the fusing nip has been a continuing problem. Previous attempts to reduce envelope wrinkling have involved relieving the pressure on the envelopes at various points in the fusing operation. An example of this approach is found in U.S. Pat. No. 5,268,726 to Oleksa et al.

It is also known to utilize individual support ribs or fingers within a paper path to reduce friction between the moving media and the surfaces of the paper path. The support fingers also serve to lessen pre-heating of the media due to heat transfer from the support surfaces of the paper path. Additionally, to prevent any one point on the image from being in extended continuous contact with a single support finger, the fingers may be angled with respect to the direction of travel of the media. This helps to avoid uneven heating of the media and image that can cause print defects and variations in the gloss of the printed image.

It is also known to angle the support fingers away from the center line of the paper path to prevent the leading corners of a media sheet from catching the sides of the fingers and pushing the media laterally to either side of the paper path. Should the media be pushed laterally prior to the fusing nip, wrinkling can occur and, in a worst case scenario, a paper jam may be created. An example of utilizing support fingers that are canted away from the center line of the paper path is found in U.S. Pat. No. 5,870,661 entitled APPARATUS AND METHOD FOR CONTROLLING MEDIA TEMPERATURE IN AN IMAGING APPARATUS and assigned to the assignee of the present application.

It has been found that support fingers that are canted away from the center line of the paper path have a disadvantage when printing envelopes. When the addressee side of an envelope is printed and the envelope travels along the paper path, the flap of the envelope on the opposite side hangs down at an angle that is canted away from the center line of the paper path, similar to the angle of the canted support fingers. As the envelope travels over the support fingers, the flap may catch the side of a finger and cause the envelope to be pushed laterally to the side or opened while moving through the fuser. This can cause severe wrinkling, print defects, and/or a media jam.

The present invention seeks to overcome the disadvantages of previous implementations of canted support fingers by changing the angle of the support fingers directly under the envelope to prevent the envelope flap from catching the side of a support finger. More specifically, the support fingers directly under the envelope in a central area are canted toward the center line of the paper path to allow the envelope flap to pass over the support fingers at an angle oblique to the angle of the support fingers. The support fingers on either side of the area over which the envelope passes are canted away from the center line of the paper path to prevent the corners of full width media from catching the surface of a rib. Accordingly, a reduction in wrinkling of both envelopes and full width media is achieved with a simple, low-cost structure.

SUMMARY OF THE INVENTION

It is an aspect of the present invention to provide a media transport unit including an envelope transport structure for supporting an envelope traveling along a media path in an imaging apparatus.

It is another aspect of the present invention that the media transport unit utilizes a plurality of media supports grouped in a first lateral portion, a second lateral portion, and a center portion between the first and second lateral portions.

It is a feature of the present invention that the center portion of media supports are canted toward the center line of the media path to allow an envelope flap to travel over the media supports without being urged laterally by a support.

It is another feature of the present invention that the media supports in the first and second lateral portions are canted away from the center line of the media path to prevent the leading corners of a full width media sheet from catching a media support and pushing the media laterally.

It is an advantage of the present invention that the envelope transport structure allows the use of individual media supports in the paper path while also preventing media and envelope wrinkling.

It is another advantage of the present invention that the envelope transport structure comprises a simple and compact design that utilizes low-cost components.

Still other aspects, features, and advantages of the present invention will become apparent to those skilled in this art from the following description, wherein there is shown and described a preferred embodiment of this invention, simply by way of illustration of one of the modes best suited to carry out the invention. As it will be realized, the invention is capable of other different embodiments and its several details are capable of modifications in various, obvious aspects, all without departing from the invention. Accordingly, the drawings and descriptions will be regarded as illustrative in nature and not as restrictive. And now for a brief description of the drawings.

Reference will now be made in detail to the present preferred embodiment of the invention, an example of which is illustrated in the accompanying drawings.

DETAILED DESCRIPTION OF THE PREFERRED EMBODIMENT

Figure 1:
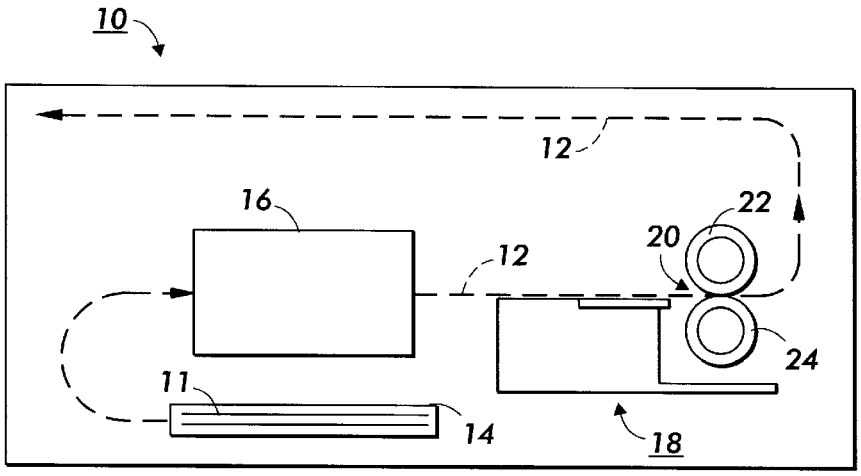
FIG. 1 is a schematic diagram of an electrophotographic printing apparatus showing the media path through the printer.

FIG. 1 is a schematic illustration of the media path 12 in an electrostatic or electrophotographic image forming apparatus 10 that utilizes the envelope transport structure of the present invention. The following description of a preferred embodiment of the invention refers to its use in an electrostatic printing apparatus. It will be appreciated, however, that the apparatus of the present invention may be used with other types of electrostatic imaging apparatus, such as photocopiers, and with other types of imaging apparatus, such as aqueous ink jet printers. Accordingly, the following description will be regarded as merely illustrative of one embodiment of the present invention.

With continued reference to FIG. 1 a receiving substrate 11, such as a sheet of paper or an envelope, is picked from a media tray 14 by a conventional pick roller mechanism (not shown). The receiving substrate 11 travels along the media path 12 and through an imaging station 16 which deposits a toner image on the receiving substrate. An example of an electrostatic imaging station is found in U.S. Pat. No. 5,576,824 (the '824 patent) entitled FIVE CYCLE IMAGE ON IMAGE PRINTING ARCHITECTURE. The '824 patent is hereby incorporated by reference in pertinent part.

After passing through the imaging station 16, the receiving substrate 11 travels over a media transport unit 18 that includes an envelope transport structure, described in more detail below. The media transport unit 18 is positioned in a pre-nip portion of the media path 12 upstream from the fusing nip 20. The fusing nip 20 is created by urging together fusing rollers 22 and 24. In the fusing nip 20, the toner image is permanently affixed to the receiving substrate 11. After passing through the fusing nip 20, the receiving substrate is transported out of the printer 10 for retrieval by a user.

Figure 2:
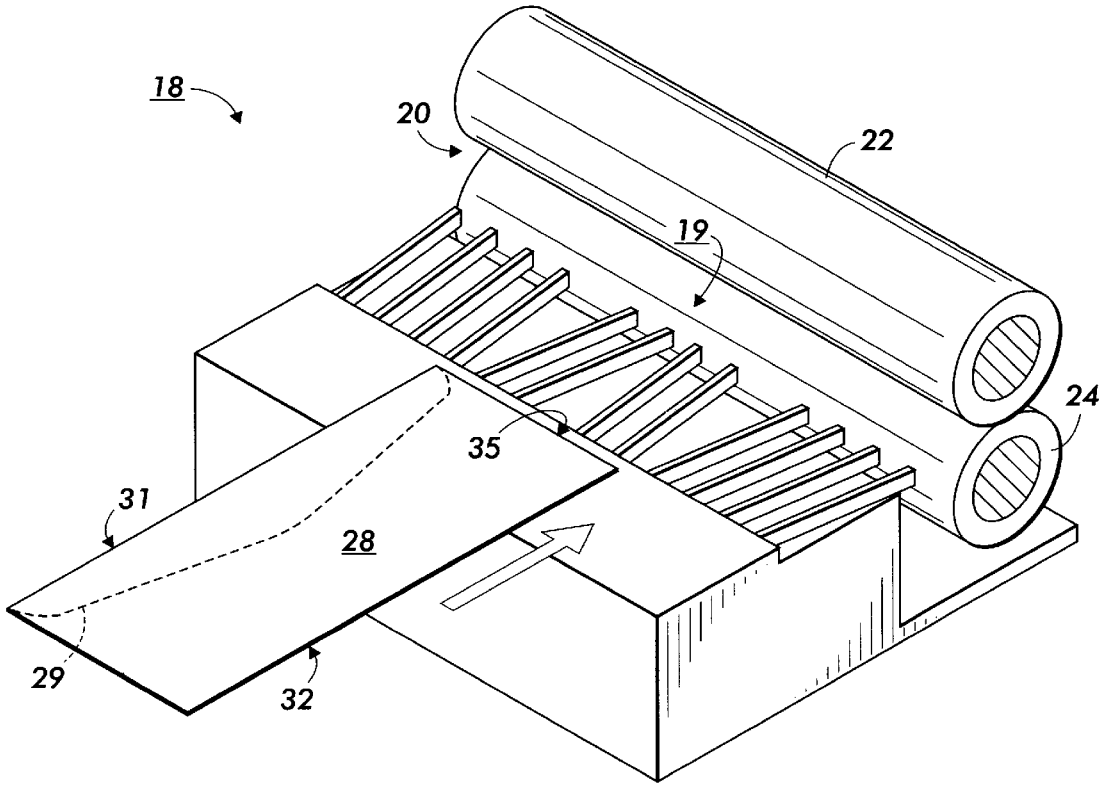
FIG. 2 is a schematic perspective view of a pair of fusing rollers forming a fusing nip and an envelope traveling along the media path and approaching an envelope transport structure upstream from the fusing nip.
Figure 3:
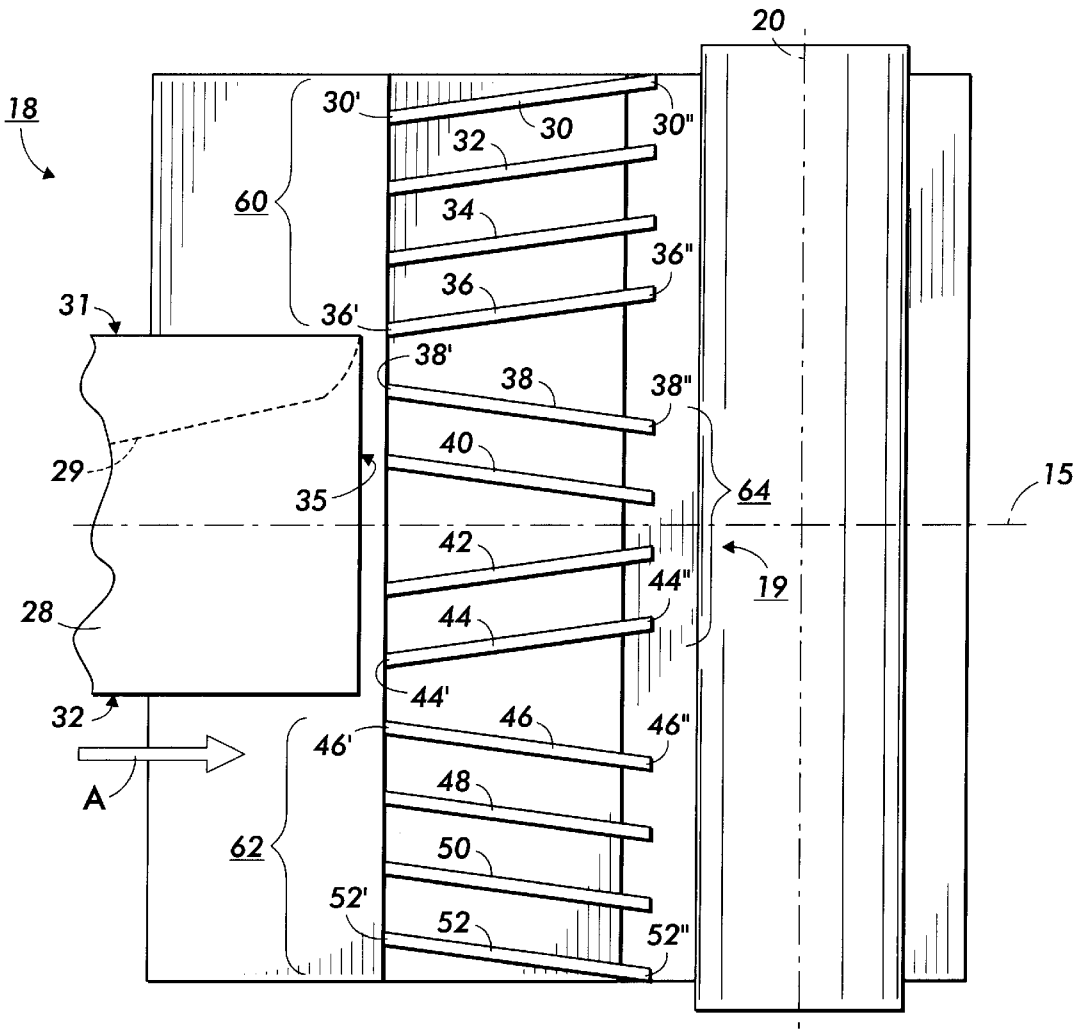
FIG. 3 is a schematic top view of the envelope transport structure showing the positioning and orientation of the individual media supports and an envelope approaching the supports.

With reference now to FIGS. 2 and 3, the arrangement and operation of the media transport unit 18 and envelope transport structure 19 of the present invention will now be described in more detail. The media transport unit 18 includes a plurality of media supports for supporting a sheet of media or an envelope as the sheet or envelope approaches the fusing nip 20. In the preferred embodiment, the media supports comprise elongated, spaced apart support fingers indicated by the even numbered reference numerals 30–52, with each finger including a first end and a second end indicated by a prime and double prime, respectively, of the corresponding reference numeral. For example, finger 30 includes a first end 30' and a second end 30".

The support fingers are arranged in a first lateral portion 60 comprising support fingers 30, 32, 34, and 36, and a second lateral portion 62 comprising support fingers 46, 48, 50, and 52. Between the first lateral portion 60 and the second lateral portion 62 is a center portion 64 comprising support fingers 38, 40, 42, and 44. As explained below, the center portion 64 of support fingers corresponds to the envelope transport structure 19. It will be appreciated that any suitable number of support fingers may be utilized in any of the first lateral, second lateral and center portions.

With continued reference to FIG. 3, the media path 12 includes a center line indicated by the dotted line 15. Sheets of media and envelopes travel in the direction of action arrow A along the media path 12 and are generally centered over the center line 15. As shown in FIG. 3, the support fingers in the first and second lateral portions 60, 62 are canted away from the media path center line 15. Preferably, each of the support fingers in the first and second lateral portions 60, 62 form an angle with the center line 15 of between about 3 degrees and about 45 degrees, and more preferably between about 10 degrees and about 20 degrees. As explained above, this ensures that the edges of a media sheet (not shown) do not contact the side of a support finger, which can urge the media sheet laterally out of alignment as it travels through the fusing nip 20 and potentially cause media wrinkling and/or a media jam.

Figure 4:
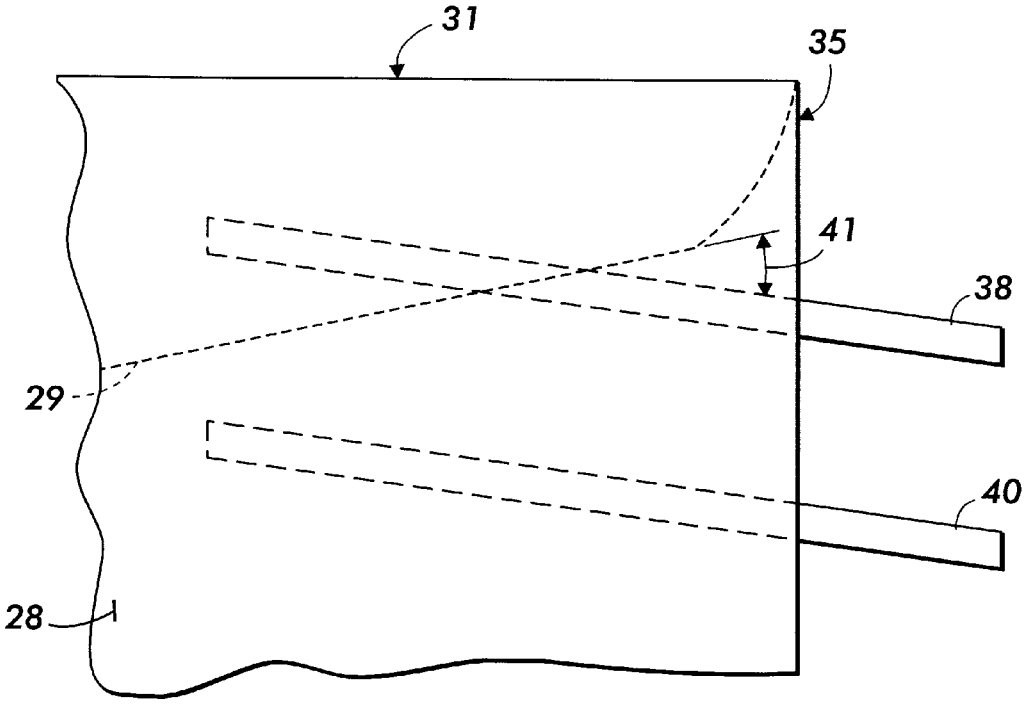
FIG. 4 is an enlarged schematic top view of the envelope traveling over the media supports.

In an important aspect of the present invention, the support fingers 38–44 in the center portion 64/envelope transport structure 19 are each canted toward the media path center line 15. Preferably, each of the support fingers 38–44 form an angle with the center line 15 of between about 3 degrees and about 45 degrees, and more preferably between about 10 degrees and about 20 degrees. With reference now to FIG. 4, as an envelope 28 travels over the envelope transport structure 19 with the envelope flap 29 on the underside of the envelope, the flap rides over the top of the support fingers 38 and 40. The flap 29 and support finger 38 initially create an acute angle 41 that allows the flap to ride over the top of the support finger.

With reference now to FIG. 3, the long edges 31, 32 of the envelope 28 travel between the first lateral portion 60 and the center portion 64 of support fingers, and between the second lateral portion 62 and center portion 64 of support fingers, respectively. In the preferred embodiment, the distance between the first end 38' of support finger 38 and the first end 44' of support finger 44 is less than the length of the short edge 35 of the envelope 28. Additionally, the distance between the first end 36' of support finger 36 and the first end 46' of support finger 46 is greater than the length of the short edge 35 of the envelope 28. It will be appreciated that standard letter envelopes have a long edge length of between about 9.5 inches (241 mm.) and 9.8 inches (250 mm.), and a short edge length of about 4.0 inches (102 mm).

In the preferred embodiment, the support fingers 38 and 40 on a first side of the center line 15 are substantially parallel. Similarly, the support fingers 42 and 44 on the opposite side of the center line 15 are substantially parallel.

While the invention has been described above with references to specific embodiments thereof, it is apparent that many changes, modifications and variations in the materials, arrangements of parts and steps can be made without departing from the inventive concept disclosed herein. Accordingly, the spirit and broad scope of the appended claims is intended to embrace the use of these other inks and all other changes, modifications and variations that may occur to one of skill in the art upon a reading of the disclosure. All patent applications and patents cited herein are incorporated by reference in their entirety.

What is claimed is:

1. An envelope transport structure for supporting an envelope having a flap as the envelope travels along a media path in an imaging apparatus, the media path including a center line, the envelope structure comprising a plurality of media supports for supporting the envelope as the envelope travels along the media path, wherein each of the plurality of media supports under the envelope in a central area is canted toward the center line of the media path in the direction of travel along the media path, whereby the envelope flap travels over and is in contact with at least one of the media supports.

2. The envelope transport structure of claim 1, wherein the plurality of media supports comprise a plurality of elongated, spaced apart fingers.

3. The envelope transport structure of claim 2, wherein the envelope includes a short edge and a long edge, each of the elongated fingers includes a first end and a second end, the plurality of fingers includes a first outermost finger and a second outermost finger, and a distance between the first end of the first outermost finger and the first end of the second outermost finger is less than a length of the short edge of the envelope.

4. The envelope transport structure of claim 3, wherein the elongated fingers on a first side of the center line are substantially parallel.

5. The envelope transport structure of claim 4, wherein the elongated fingers on a second side of the center line are substantially parallel.

6. The envelope transport structure of claim 5, wherein the elongated fingers are canted toward the center line of the media path at an angle of between about 3 degrees and about 45 degrees with respect to the center line.

7. The envelope transport structure of claim 6, wherein the elongated fingers are positioned in a pre-nip portion of the media path that is upstream from a fusing nip in the imaging apparatus, and wherein the second end of each of the elongated fingers is closer to the fusing nip than the first end of each of the elongated fingers.

8. The envelope transport structure of claim 7, wherein the length of the short edge of the envelope is about four inches.

9. An image apparatus capable of imaging an envelope having a flat, the image apparatus comprising:

an imaging station for applying imaging material to the envelope to create an image;

a fusing station for fusing the imaging material into the envelope;

a media path having a center line and extending between the image station and the fusing station; and an envelope transport structure upstream from the fusing station, the envelope transport structure comprising a plurality of media supports for supporting the envelope as the envelope travels along the media path, wherein each of the plurality of media supports under the envelope in a central area is canted toward the center line of the media path in the direction of travel along the media path towards the fusing station;

whereby the envelope flap travels over and is in contact with at least one of the media supports.

10. The imaging apparatus of claim 9, wherein the plurality of media supports comprise a plurality of elongated, spaced apart fingers.

11. The imaging apparatus of claim 10, wherein the envelope includes a short edge and a long edge, each of the elongated fingers includes a first end and a second end, the plurality of fingers is bounded by a first outermost finger and a second outermost finger, and a distance between the first end of the first outermost finger and the first end of the second outermost finger is less than a length of the short edge of the envelope.

12. The imaging apparatus of claim 11, wherein the elongated fingers on a first side of the center line are substantially parallel.

13. The imaging apparatus of claim 12, wherein the elongated fingers on a second side of the center line are substantially parallel.

14. The imaging apparatus of claim 13, wherein the elongated fingers are canted toward the center line of the media path at an angle of between about 3 degrees and about 45 degrees with respect to the center line.

15. The imaging apparatus of claim 14, wherein the elongated fingers are positioned in a pre-nip portion of the media path that is upstream from a fusing nip in the imaging apparatus, and wherein the second end of each of the elongated fingers is closer to the fusing nip than the first end of each of the elongated fingers.

16. The imaging apparatus of claim 15, wherein the length of the short edge of the envelope is about four inches.

17. A media transport unit for supporting a receiving substrate as the receiving substrate travels along a media path in an imaging apparatus, the media path including a center line, the media transport unit comprising:

a plurality of media supports for supporting the receiving substrate as the receiving substrate travels along the media path, the plurality of media supports including a first lateral portion, a second lateral portion and a center portion between the first lateral portion and the second lateral portion;

the media supports in the first lateral portion and the second lateral portion being canted away from the center line of the media path; and the media supports in the center portion being canted toward the center line of the media path.

18. The media transport unit of claim 17, wherein the plurality of media supports comprise a plurality of elongated, spaced apart fingers.

19. The media transport unit of claim 18, wherein the receiving substrate comprises an envelope that includes a short edge and a long edge, each of the elongated fingers includes a first end and a second end, the center portion of fingers includes a first outermost finger and a second outermost finger, and a distance between the first end of the first outermost finger and the first end of the second outermost finger in the center portion is less than a length of the short edge of the envelope.

20. The media transport unit of claim 19, wherein the first lateral portion includes a first innermost finger adjacent to the first outermost finger in the center portion, and the second lateral portion includes a second innermost finger adjacent to the second outermost finger in the center portion, and a distance between the first innermost finger and the second innermost finger is greater than the length of the short edge of the envelope.

* * * * *